US006736477B2

(12) United States Patent
Tsuruoka

(10) Patent No.: US 6,736,477 B2
(45) **Date of Patent: *May 18, 2004**

(54) PRINTING APPARATUS AND PRINTING METHOD

(75) Inventor: Yuji Tsuruoka, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/219,897

(22) Filed: Dec. 24, 1998

(65) Prior Publication Data

US 2002/0180820 A1 Dec. 5, 2002

(30) Foreign Application Priority Data

Dec. 29, 1997 (JP) ..... 9-369108

(51) Int. Cl.[7] ..... B41J 29/393
(52) U.S. Cl. ..... 347/19; 347/14; 347/17
(58) Field of Search ..... 347/7, 9–19, 23; 399/12, 13

(56) References Cited

U.S. PATENT DOCUMENTS

| | | | | |
|---|---|---|---|---|
| 5,365,312 A | | 11/1994 | Hillmann et al. | 355/206 |
| 5,610,635 A | * | 3/1997 | Murray et al. | 347/19 |
| 6,050,669 A | * | 4/2000 | Yano et al. | 347/23 |
| 6,106,088 A | * | 8/2000 | Wafler | 347/12 |
| 6,109,714 A | * | 8/2000 | Tsuruoka | 347/7 |
| 6,163,658 A | * | 12/2000 | Suzuki | 399/12 |

FOREIGN PATENT DOCUMENTS

| | | |
|---|---|---|
| EP | 571093 | 11/1993 |
| EP | 789322 | 8/1997 |
| JP | 2-165954 | 6/1990 |
| JP | 5-169675 | 7/1993 |
| JP | 5-173729 | 7/1993 |
| JP | 5-193127 | 8/1993 |
| JP | 05-301349 | 11/1993 |
| JP | 08-174863 | 7/1996 |
| JP | 08-230213 | 9/1996 |
| JP | 9-190138 | 7/1997 |
| WO | WO 90/00974 | 2/1990 |
| WO | WO 98/04414 | 2/1998 |

* cited by examiner

*Primary Examiner*—Stephen D. Meier
*Assistant Examiner*—Ly T Tran
(74) *Attorney, Agent, or Firm*—Fitzpatrick, Cella, Harper & Scinto

(57) ABSTRACT

When an exchanged ink tank is considered as "brandnew" by an information writing circuit, a first fuse is blown. A third fuse to the fifth fuse are blown according to individual discrimination number next to the used individual discrimination number stored in a RAM. Then, an integrating counter according to the individual discrimination number is selected and this selected counter value is reset. On the other hand, when the exchanged ink tank is considered as "used", and individual discrimination number written by the third fuse to the fifth fuse is read out, and the integrating counter according to the individual discrimination number is selected. The number of printing dots per line is counted and the integrating value is compared to the predetermined waste count number of ink per line. When the integrating value is over the waste count number, an empty message is shown on a display portion.

18 Claims, 8 Drawing Sheets

PRINTING APPARATUS AND PRINTING METHOD

BACKGROUND OF THE INVENTION

1. Field of the Invention

The present invention relates to a printing apparatus having a mounting portion for an exchangeable ink tank.

2. Description of the Related Art

Whether or not ink remains in an ink tank of an ink-jet printing apparatus can be confirmed by looking at the ink in a transparent ink tank. However, it is difficult for a user to check the amount of ink remaining in a type of ink tank which stores the ink permeated into a sponge or a porous member.

To detect the amount of ink remaining in this type of ink tank, for example there is a method which integrates the number of printing dots and calculates ink consumption from the integrated value to detect the amount of ink remaining. However, where a plurality of the exchangeable ink tanks are used, the amount of ink remaining that is detected by the above integrating method does not correspond to the ink remaining stored in each ink tank.

When a printing apparatus is used with a plurality of exchangeable ink tanks, it is considered that ink tanks with predetermined barcodes are utilized and, as a result, each of the predetermined barcodes are utilized and, as a result, each of ink tanks can be distinguished. However, since some of the ink tanks may utilized the same barcode, it may be distinguished by mistake and, therefore, it is difficult to discriminate the ink tanks with the barcode individually. In the above construction, it is difficult to distinguish whether the ink tank is brandnew and if a used ink tank happens to be mounted by mistake, control of the cartridge is left to the user.

SUMMARY OF THE INVENTION

An object of the present inventions to provide an ink-jet printing apparatus, which is able to individually discriminate an ink tank and is able to inform a user of an amount of ink remaining.

In a first aspect of the present invention, there is provided a printing apparatus having a mounting portion for mounting an ink tank and performing printing by using a printing head ejecting an ink, the apparatus comprising:

memory for storing the information;

writing means for writing the information into an information storing portion of the ink tank;

reading means for reading the information form the information storing portion of the ink tank;

control means for setting discrimination information at the ink tank and writing the discrimination information by the writing means, and storing the discrimination information in the memory.

In a second aspect of the present invention, there is provided a printing method performing printing by using a mounting portion for mounting ink tank and a printing head ejecting an ink, the method comprising:

storing step of storing the information in memory;

writing step of writing the information into an information storing portion of the ink tank;

reading step of reading the information from the information storing portion of the in tank; and control step of setting the discrimination information at the ink tank and writing the discrimination information, and storing the discrimination information in the memory.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Preferred embodiment of the present invention will be described in detail with reference to the drawings.

The first embodiment of the present invention will be described with reference to FIGS. 1 to 5.

An ink-jet printing apparatus is as follows.

Figure 1:
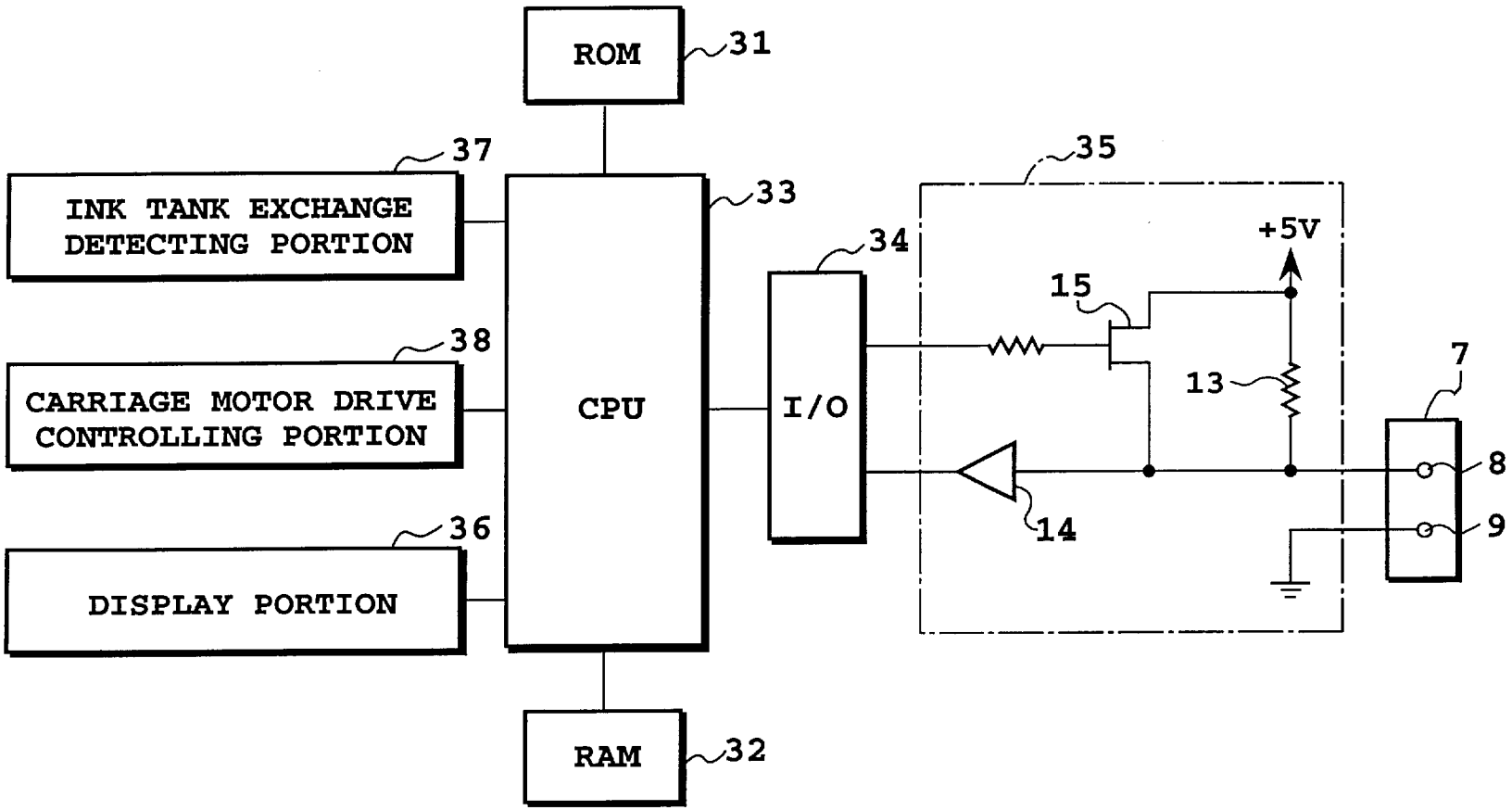
FIG. 1 is a block diagram of a first embodiment according tot he present invention.
Figure 2B:
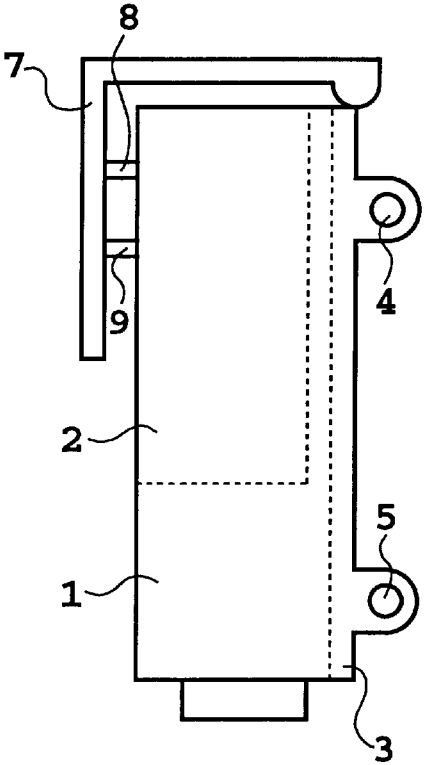
FIG. 2A is a plan view and FIG. 2B is a side view for showing an arrangement of a contact lever and a carriage.
Figure 2A:
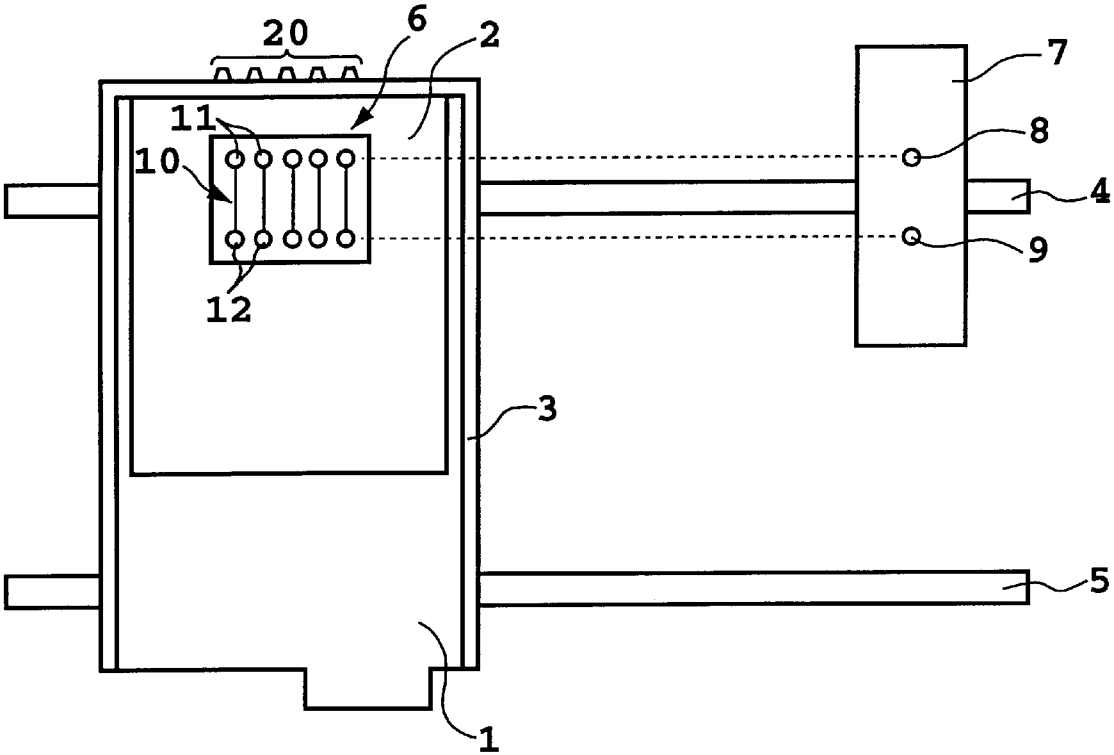
Figure 3:
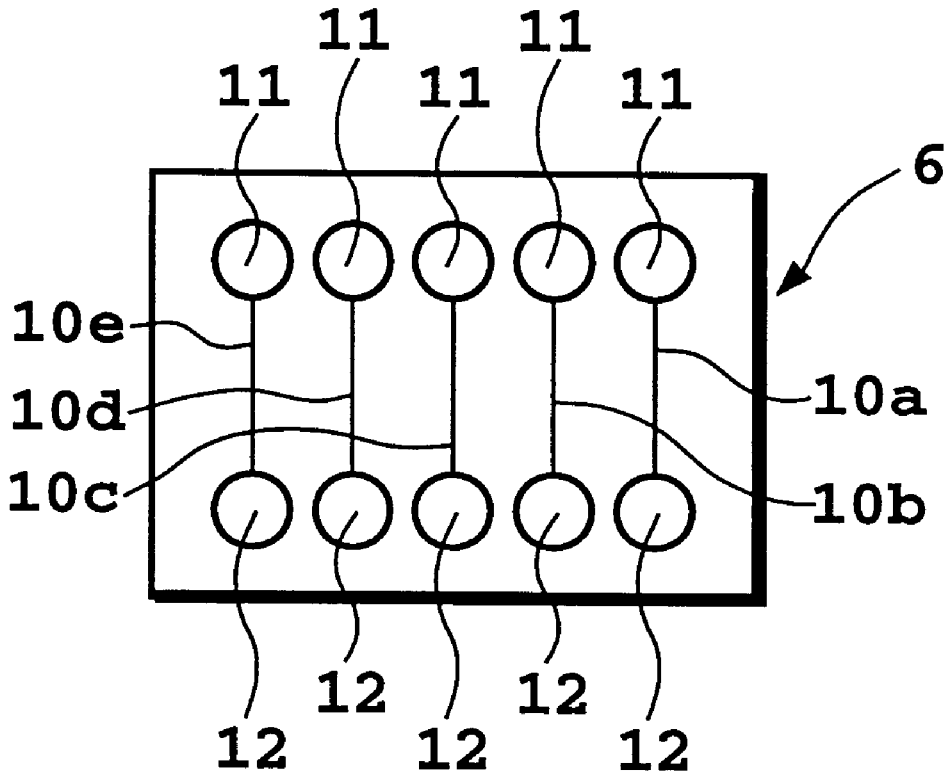
FIG. 3 is a schematic view for showing a fuse label.

As shown in FIG. 1 reference numeral 7 denotes a contact lever. FIGS. 2A and 2B show the structure of the contact lever 7. Reference numeral 35 of FIG. 1 denotes an information writing reading circuit. As shown in FIG. 3, the information writing reading circuit 35 performs a process of writing and reading about fuse patterns 10*a* to 10*e*. That is the process writes the information of "brandnew" or "used", the information of "ink remain full" or "ink remain empty", and the information of "individual discrimination number" onto the fuse patterns 10*a* to 10*e*, and read those informations from the fuse patterns 10*a* to 10*e*.

A reference numeral 37 in FIG. 1 is an ink tank exchange detecting portion which detects movement of exchanging an ink tank. Reference numeral 38 is a carriage motor drive controlling portion which drives a carriage motor (not shown) and moves the carriage 3 (see FIGS. 2A and 2B) to the contact lever 7 when the ink tank exchange of the ink tank. Reference numeral 31 is a ROM (read only memory) storing control program.

Reference numeral 32 is a RAM (random access memory). The RAM 32 stores the individual discrimination number according to each of the plurality of ink tanks and is used as a working area for the CPU 33. In this embodiment, when a brandnew ink tank is mounted on the carriage 3, the individual discrimination number according to the brandnew ink tank is set, and the individual discrimination number is memorized in an information memorizing portion of the ink tank and is stored in the RAM 32. Thus, the newly mounted in tank can be distinguished from other ink tanks and the information, such as an amount of ink remaining in the ink tank, can be controlled individually.

A portion of the RAM 32 is utilized for integrating counter groups structured by eight integrating counters according to a maximum individual discrimination number, and each integrating counter corresponds to the individual discrimination number. The CPU 33 adds the number of printing dots output from a gate array to the original stored value per line. Reference number 33 is a CPU (central processing unit) controlling each portion according to a control program. The CPU 33 drives the information writing reading circuit 35 via I/O (input/output) 34 and selects a counter according to the individual discrimination number read out from the information writing reading circuit 35 among the counter groups in the RAM 32, and controls the carriage motor drive controlling portion 38 when the ink tank exchange detecting portion 37 detects the exchange of the ink tank.

As the individual discrimination number, 0 is set for the first ink tank and a number is successively set for each of the other ink tanks up to 7, and then 0 is set again. A reference numeral 36 is a display portion. The display portion 36 displays the state in which the ink amount remaining in the ink tank is below a certain amount and when the ink is empty, and informs a user by an alarm.

The information writing reading circuit 35 will now be described in more detail with regard to FIGS. 1 to 3.

Contact 8 of the contact lever 7 is connected to a power supply via a pull-up resistance 13 and is connected to the CPU 33 via buffer 14 and the I/O 34. Contact 9 of the contact lever 7 is connected to a ground. When the contacts 8 and 9 contact pads 11 and 12 of the fuse patterns 10*a* to 10*e*, a short may occur between the contacts 8 and 9 via a fuse. An L (=low level) signal is output via the buffer 14 when a short occurs, and an H (=high level) signal is output via the buffer 14 when a short has not occurred.

On the other hand, an FET (field effect transistor) 15 is connected to the pull-up resistance 13 in parallel, and a gate of the FET 15 is connected to the CPU 33 via the I/O 34. When a fuse blowing signal is output from the CPU 33, the FET 15 starts up and electric current flows to a fuse between the contacts 8 and 9, then the fuse is blown.

FIGS. 2A and 2B show the placement relationship between the contact lever 7 and the carriage 3.

In FIG. 2A a reference numeral 1 is an ink-jet head which generates a bubble in the ink by using thermal energy and ejects ink from a printing head. Reference numeral 2 is an exchangeable ink tank having the fuse label 6.

FIG. 3 is a schematic view for showing the fuse label 6 in detail.

The fuse patterns 10*a* to 10*e* are formed by etching the fuse label 6, and the electric pads 11 and 12 are arranged at both sides of the fuse patterns 10 to 10*e*. The fuse patterns 10*a* to 10*e* are used for storing "the information". The first fuse 10*a* indicates "brandnew" according to non-blowing or "used" according to blowing. The second fuse 10*b* indicates "ink remain full" according to non-blowing or "ink remain empty" according to blowing. The third fuse 10*c* to the fifth fuse 10*e* correspond to weights of 1, 2 and 4, respectively, and can indicate the individual discrimination numbers of 0 to 7 inclusive. For example, when both the fourth fuse 10*d* and the fifth fuse 10*e* have been blown, 6 is indicated as the individual discrimination number.

Reference numeral 3 is a carriage for mounting the ink-jet head 1 and the ink tank 2. As shown in FIG. 2A the carriage 3 moves along guide bars 4 and 5. Five projections 20 are formed on the side of the carriage 3 according to the first fuse 10*a* to the fifth fuse 10*e*. Reference numeral 7 is a contact lever shaped like a "reverse-L" and is positioned at the edge in the moving area of the carriage 3. When the carriage 3 moves until it contacts contact lever 7, the contact lever 7 is vibrated by the projections 20, and the contacts 8 and 9 are connected to the electric pads 11 and 12 at both sides of the fuse patterns 10*a* to 10*e*.

By the movement of the carriage 3, the ejection openings of the printing head eject ink onto a printing medium to perform one-line of printing. The movement of the printing medium according to one-line width (the predetermined area, such as a printing width according to one scan by using the ink-jet head 1) is repeatedly performed every one-line of printing to form the image on to a sheet. The carriage 3 cannot reach the contact lever 7 during normal printing, but can reach the contract lever 7 when the printing head 1 or the ink tank 2 is exchanged.

Figure 4:
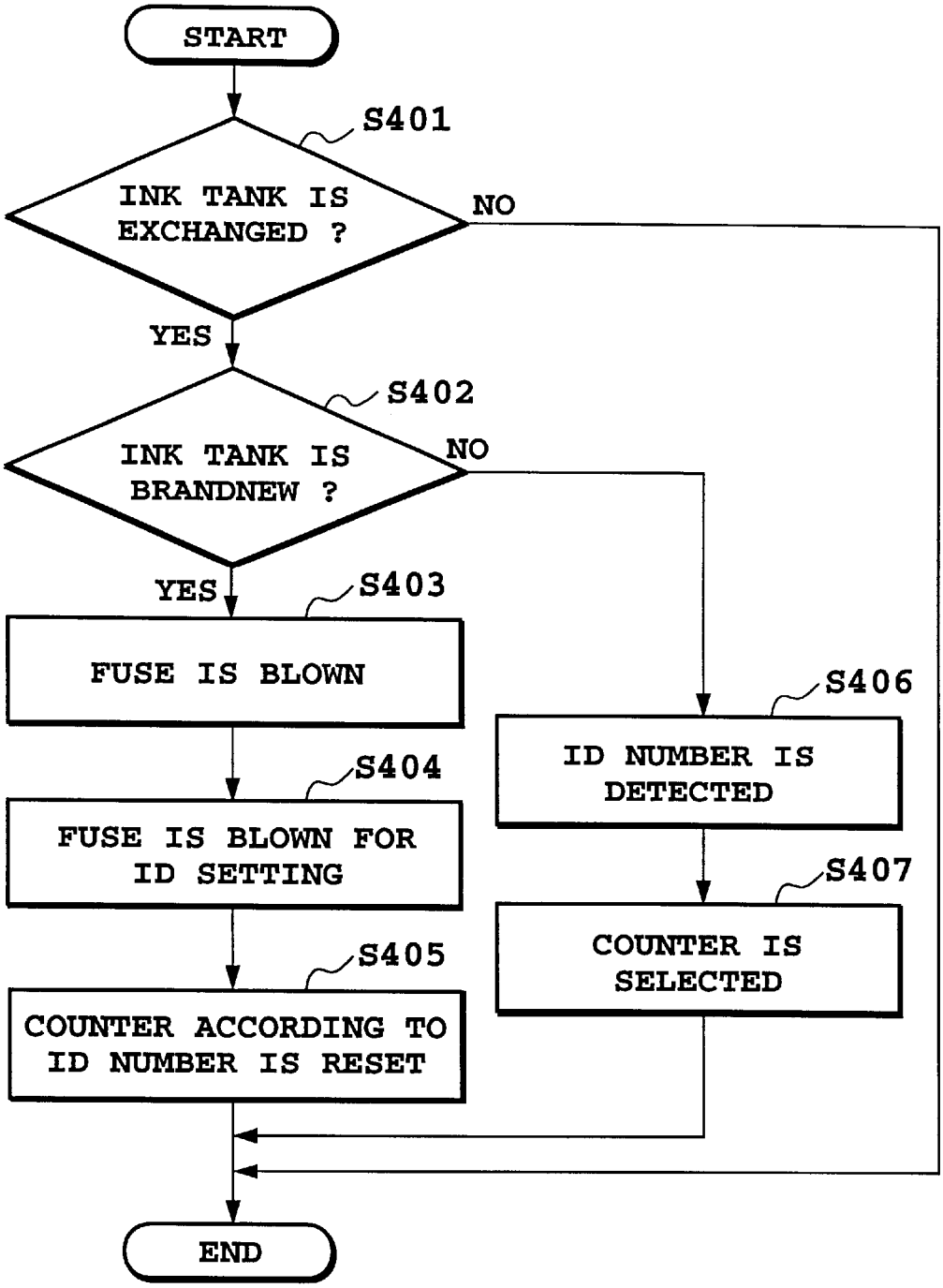
FIG. 4 is a flowchart showing an example of a control program stored in the ROM of FIG. 1.

FIG. 4 is a flowchart showing a control program memorized in the ROM 31.

When the ink tank 2 is exchanged at the predetermined position by a user, a switch operates and the ink tank exchange detecting portion 37 detects the exchange of the ink tank 2 (S401). Thus, the carriage motor drive controlling portion 38 drives a carriage motor and the carriage 3 is moved to the contact lever 7. Further, the contact lever 7 is vibrated by the projections 20 on the side of the carriage 3 and the contacts 8 and 9 of the contact lever 7 are connected to the pads 11 and 12 of the first fuse 10*a*. By this connection, whether the ink tank 2 is "brandnew" or "used" can be distinguished according to a signal level from the information writing reading circuit 35 (S402).

When the L signal is output from the information writing reading circuit 35, the exchanged ink tank is considered as "brandnew", and the fuse blowing signal is output from the CPU 33 to blow the first fuse 10*a* (S403). The third fuse 10*c* to the fifth fuse 10*e* are blown according to the used individual discrimination number next to the latest used individual discrimination number stored in the RAM 32 (S404). Then, the integrating counter according to the individual discrimination number is selected from the integrating counter groups and the selected counter value is reset (S405).

On the other hand, when the H signal is output from the information writing reading circuit 35, the exchanged ink tank is considered as "used", and the individual discrimination number written by the third fuse 10*c* to the fifth fuse 10*e* is read out (S406). The integrating counter according to the individual discrimination number is selected from the integrating counter groups, and the selected counter value is reset (S407).

Figure 5:
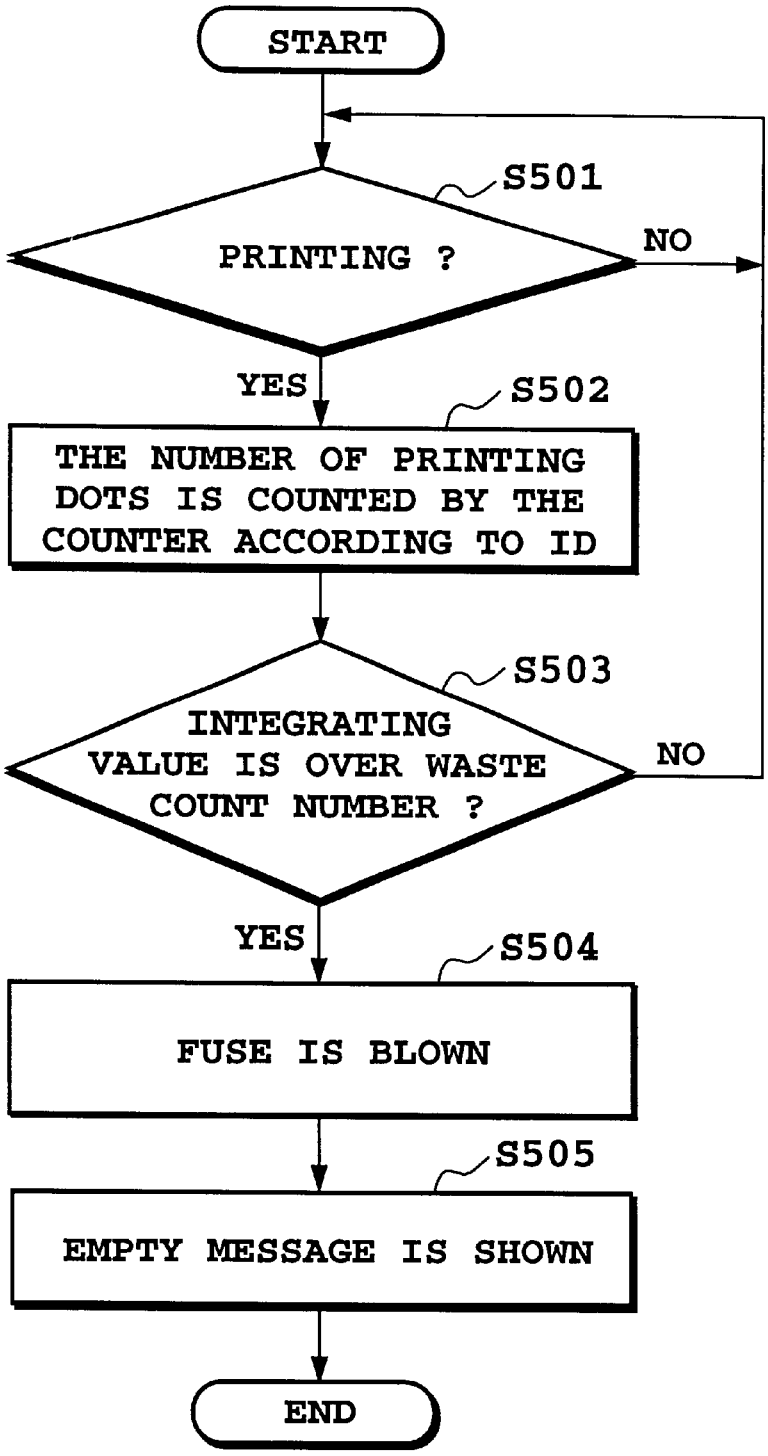
FIG. 5 is a flowchart showing an example of an ink amount remaining detection program in the ROM of FIG. 1.

FIG. 5 is a flowchart showing an ink amount remaining detecting program stored in the ROM 31 of FIG. 1.

The printing image signal transferred from the host computer is received by the gate array of the ink-jet printing apparatus and is converted into image data according to the printing order of the ink-jet printing apparatus and is converted into image data according to the printing order of the ink-jet head 1 (S501). The number of printing dots per line is counted by the activated integrating counter (S502). The integrating value of the integrating counter is compared to the predetermined waste counter number of ink per line (S503). When the integrating value of the integrating counter is over the waste count number, the carriage motor is driven by the carriage motor drive controlling portion 38 and the carriage 3 is moved to the contact lever 7. When the contacts 8 and 9 contact with the pads 11 and 12 of the second fuse 10*b*, the fuse blowing signal is output to blow the second fuse 10*b* (S504). When the amount of ink remaining in the ink tank is below a certain level, an empty message is shown on the display portion 36, and that makes a user exchange the ink tank (S505).

When the ink tank showing the low level of ink remaining is set again, the information writing reading circuit 35 detects the blowing of the second fuse 10*b* and the H signal is output. Then, the display portion 36 shows that the ink in the ink tank is becoming empty, and that makes a user exchange the emptied ink tank, thus preventing a user from misoperating.

In the above example, a message that amount of the ink remaining in the ink tank is becoming empty is displayed on the display portion 36 and that makes a user exchange the ink tank. But, the present invention is not limited to the above example and can be applied to another method in which the ink remaining in the ink tank is calculated by the integrating value of the integrating counter and the amount of ink remaining is shown to make a user exchange the emptied ink tank.

The second embodiment of the present invention will be described with reference to FIGS. 6 to 8.

This example is different from the previous example in writing and reading information, because this embodiment is different from the previous embodiment in the structure of memory portion for storing information.

Figure 8:
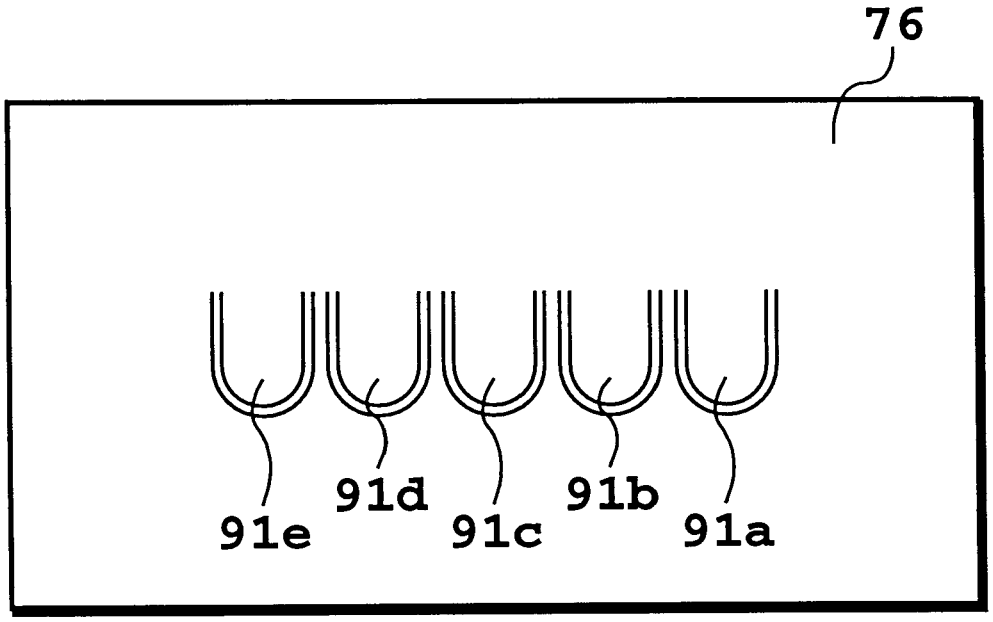
FIG. 8 is a schematic view for the construction of the memory portion as a second embodiment according to the present invention.

As shown in FIG. 8, the memory portion 76 according to the present invention is stuck on each of the ink tanks 2 and has five nails 91*a* to 91*e* performing plastic deformation according to a printing portion. The first nail 91*a* indicates "brandnew" when plastic deformation does not occur and it indicates "used" when the plastic deformation does occur. The second nail 91*b* indicates "ink remain full" when plastic deformation does not occur and it indicates "ink remain empty" when plastic deformation occurs. The third nail 91*c* to the fifth nail 91*e* correspond to weights of 1, 2 and 4, respectively, and can indicate the individual discrimination numbers of 1 to 7 inclusive. For example, when both the fourth nail 91*d* and the fifth nail 91*e* have been plasticly deformed, 6 is indicated as the individual discrimination number.

Figures 7A, 7B:
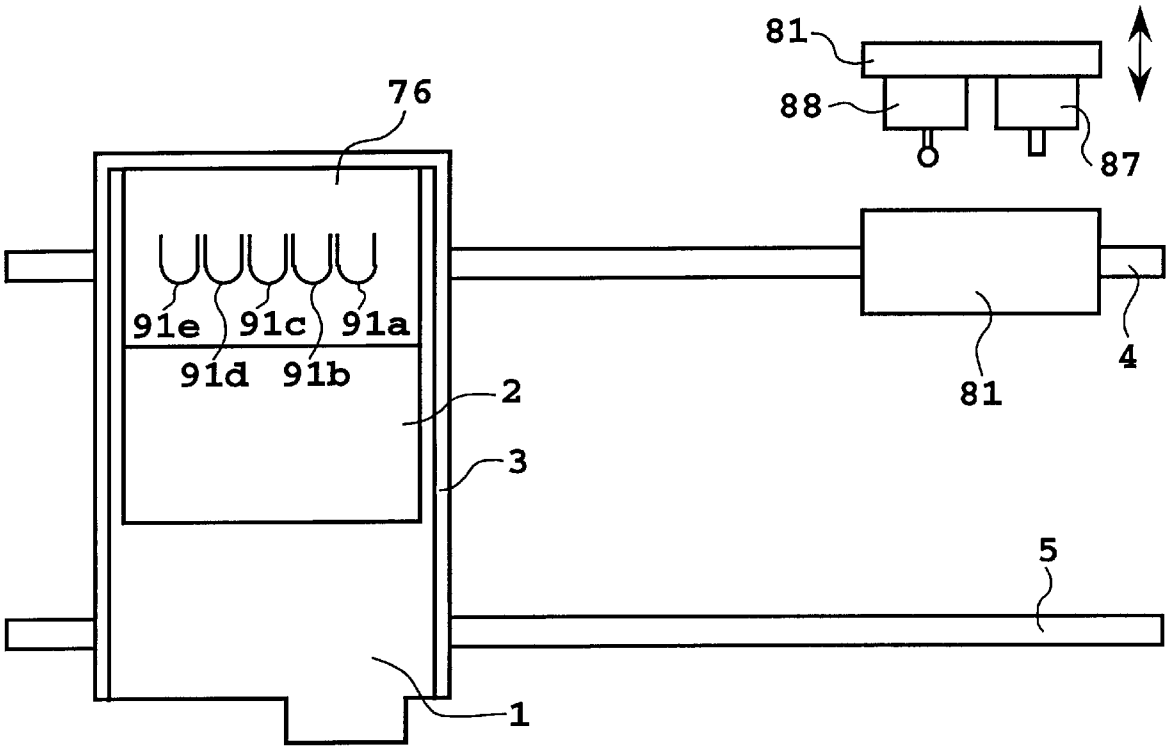
FIG. 7A is a front view for a writing reading system and FIG. 7B is a plan view for showing the arrangement of the writing reading system and the carriage.

In FIG. 7A, the writing reading system 81 is constructed by the nail bending machine 87 and the microswitch 88, and is positioned at the right side of the carriage 3 in the moving area.

Figure 6:
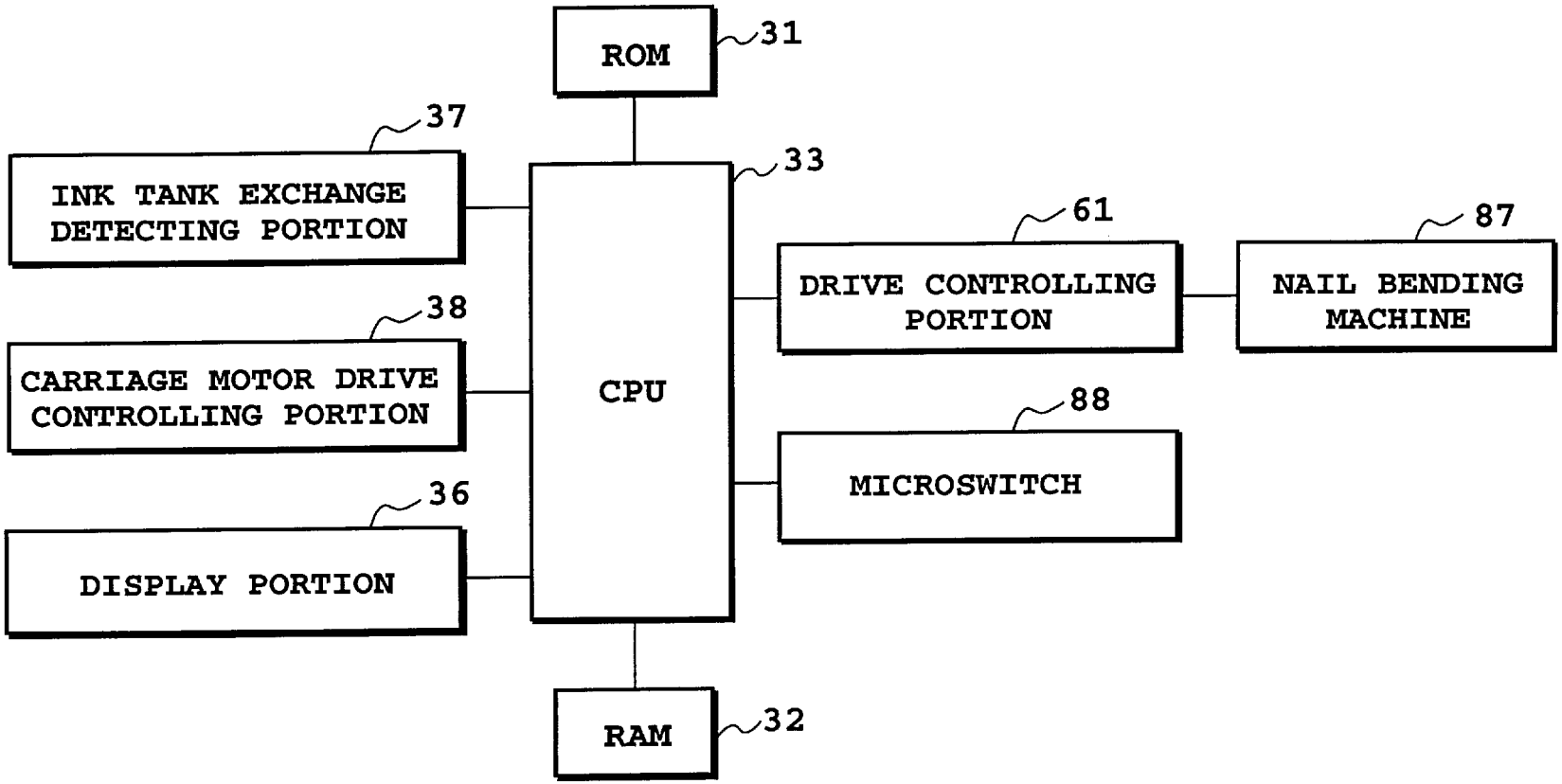
FIG. 6 is a block diagram of a second embodiment according to the present invention.

As shown in FIGS. 6 and 7B, the CPU 33 outputs a nail bending signal, and then the drive controlling portion 61 controls the nail bending machine 87 of the writing reading system 81 and the nail bending machine 87 bends the nails 91*a* to 91*e* to memorize the information onto the memory portion 76. When the microswitch 88 does not detect the bending of the first nail 91*a*, the nail bending signal is output from the CPU 33 at a time between the first nail 91*a* and the nail bending machine 87 confronting each other. The nail bending signal is output from the CPU 33 according to the individual discrimination number at the time between the nail indicating the individual discrimination number of the third nail 91*c* to the fifth nail 91*e* and the nail bending machine 87 confronting each other. When the second nail 91*b* indicates "ink remain empty", the nail bending signal is output from the CPU 33 at the time between the second nail 91*b* and the nail bending machine 87 confronting each other.

On the other hand, the microswitch 88 of the writing reading system 81 detects the bending of the nail 91*a* toggle to read out information from the memory portion 76.

The present invention is not limited to the example of "nail-bending" but may also be applicable for "nail-removing".

As described above, the ink-jet printing apparatus includes an ink tank based on the printing head, and may be able to include a monochromatic ink tank and a color ink tank according to the printing head used.

The present invention is applicable for an ink jet printing apparatus by using the cartridge type head having an ink tank and a printing head structured in a body. Similarly, the present invention is also applicable for an ink-jet printing apparatus having a monochromatic printing head cartridge and a color printing head cartridge in a type of an ink tank and printing head structured in a body.

As mentioned above, the fuse performing electrical isolation is used for the information and the nail portions performing physical transformation is used for the information, as a construction for memorizing the information showing "brandnew" or "used", the information showing "ink remain" and the individual discrimination number about an exchangeable ink tank and a head cartridge.

The present invention is not limited to the above construction but can also be applicable for a method as follows.

Whether the ink tank is brandnew or not is distinguished when the ink tank is mounted, and the individual discrimination number according to the brandnew tank is memorized in a printing body for control, and further the information such as an ink current remaining is memorized according to application. Therefore, memory means, such as the RAM for writing and reading information can also be applied to the present invention.

In the above example, the ink tank storing ink is described as the exchangeable portions. The present invention is not limited to the ink tank but can be applied to other exchangeable portions. For example, in a transcribing printing apparatus performing printing by using an ink ribbon, the individual discrimination number is memorized in the cassette having the ink ribbon when the cassette is mounted with the printing body, and the printing body may be able to control the usage rate of the ink ribbon according to the individual discrimination number.

As described above, according to the present invention, the printing apparatus can inform a user of the time to exchange the ink tank and can inform a user of an ink amount remaining.

Further, according to the present invention, when the exchangeable portion is mounted with the printing body, the printing body sets the individual discrimination information to the exchangeable portion and the printing body can memorize the set individual discrimination information. By controlling the individual discrimination information according to the using process per the information, whether the portion is brandnew or not can be distinguished when the portion is exchanged, and the printing body can confirm the using process individually when the portion is exchanged frequently, thereby improving the convenience and usefulness of printing.

The present invention has been described in detail with respect to preferred embodiments, and it will now be apparent from the foregoing to those skilled in the art that changes and modifications may be made without departing from the invention in its broader aspect, as it is the invention, therefore, in the apparent claims to cover all such changes and modifications as fall within the true spirit of the invention.

What is claimed is:

1. An ink-jet printing apparatus having a mounting portion for mounting a detachable ink tank that stores ink, the ink tank having an information storing portion for storing information pertaining to the ink tank, and the ink-jet printing apparatus performing printing by ejecting from a printing head the ink stored in said ink tank, the ink-jet printing apparatus comprising:

a memory incorporated in a body of the printing apparatus for storing information;

writing means for writing information pertaining to the ink tank into said information storing portion of said ink tank while said ink tank is mounted in said mounting portion;

reading means for reading information from said information storing portion of said ink tank while said ink tank is mounted in said mounting portion; and control means for judging, when an exchange of said ink tank is detected by said printer, whether said ink tank is brand new based on said information read from said information storing portion of said ink tank by said reading means, for setting individual discrimination information for the ink tank that discriminates the ink tank from other ink tanks in the case that the ink tank is exchanged and is judged as brand new, and for memorizing the set individual discrimination information into said information storing portion of said ink tank by using said writing means, wherein, when said control means judges the exchanged ink tank as brand new, said control means causes said memory to memorize the individual discrimination information which is set in said information storing portion of said ink tank.

2. The printing apparatus as claimed in claim 1, further comprising:

detecting means for detecting exchange of said ink tank according to said ink tank being removed from said mounting portion or being inserted into said mounting portion, wherein said control means reads said information from said information storing portion of said ink tank when said ink tank is exchanged.

3. The printing apparatus as claimed in claim 1, further comprising:

distinction means for distinguishing a using process about said ink tank mounted on said mounting portion, wherein said control means stores said using process of said ink tank according to each discrimination information in said memory.

4. The printing apparatus as claimed in claim 1, wherein said control means writes the information showing said discrimination information and a using process of said ink tank into said information storing portion of said ink tank by using said writing means.

5. The printing apparatus as claimed in claim 1, further comprising:

detecting means for detecting a consumption amount of ink for said ink tank, wherein said control means stores information showing said consumption amount of ink according to the discrimination information of the ink tank in said memory.

6. The printing apparatus as claimed in claim 5, further comprising:

distinction means for distinguishing whether or not a remaining amount of ink in said ink tank is below a predetermined value according to said consumption amount of ink, wherein said control means writes information showing said remaining amount of ink into said information storing portion of said ink tank by using said writing means when said remaining amount of ink is below said predetermined value.

7. The printing apparatus as claimed in claim 6, further comprising:

alarm means for informing a user of an alarm, wherein said alarm means informs the user of the alarm when said remaining amount of ink is below said predetermined value.

8. The printing apparatus as claimed in claim 7, further comprising:

detecting means for detecting an exchange of said ink tank according to removing said ink tank from said mounting portion or inserting said ink tank into said mounting portion, wherein said control means reads said information showing said remaining amount of ink from said information storing portion of said ink tank when said ink tank is exchanged, and informs the user of the alarm when said remaining amount of ink in said ink tank is below said predetermined value according to said information showing said remaining amount of ink.

9. The printing apparatus as claimed in claim 1, wherein said printing head ejects the ink by utilizing a thermal energy, and said printing head includes an element generating a thermal energy applied to said ink.

10. A control method of an ink-jet printing apparatus having a mounting portion for mounting a detachable ink tank that stores ink, the ink tank having an information storing portion for storing information pertaining to the ink tank, and the ink-jet printing apparatus performing printing by ejecting from a printing head the ink stored in the ink tank, said method comprising:

a storing step of storing information in a memory, the memory being incorporated in a body of the printing apparatus;

a writing step of writing information pertaining to the ink tank into said information storing portion of said ink tank while said ink tank is mounted in said mounting portion;

a reading step of reading information from said information storing portion of said ink tank while said ink tank is mounted in said mounting portion; and a control step of judging, when an exchange of said ink tank is detected by said printer, whether said ink tank is brand new based on said information read from said information storing portion of said ink tank by said reading step, setting individual discrimination information for the ink tank that discriminates the ink tank from other ink tanks in the case that the ink tank is exchanged and is judged as brand new, and for memorizing the set individual discrimination information into the information storing portion of the ink tank using the writing step, wherein, when said control step judges the exchanged ink tank as brand new, the control step causes the storing step to memorize in the memory the individual discrimination information which is set in the information storing portion of the ink tank.

11. The control method as claimed in claim 10, further comprising:

a detecting step of detecting exchange of said ink tank according to said ink tank being removed from said mounting portion or being inserted into said mounting portion, wherein said control step reads said information from said information storing portion of said ink tank when said ink tank is exchanged.

12. The control method as claimed in claim 10, further comprising:

a distinction step of distinguishing a using process about said ink tank fitted into said mounting portion, wherein said control step comprises storing said using process of said ink tank according to each discrimination information in said memory.

13. The control method as claimed in claim 10, wherein said control step comprises writing the information showing said discrimination information and the using process of said ink tank into said information storing portion of said ink tank.

14. The control method as claimed in claim 10, further comprising:

a detecting step of detecting a consumption amount of ink for said ink tank, wherein said control step comprises storing information showing said consumption amount of ink according to the discrimination information of the ink tank in said memory.

15. The control method as claimed in claim 14, further comprising:

a distinction step of distinguishing whether or not a remaining amount of ink in said ink tank is below a predetermined value according to said consumption amount of ink, wherein said control step comprises writing information showing said remaining amount of ink into said information storing portion of said ink tank when said remaining amount of ink is below said predetermined value.

16. The control method as claimed in claim 15, further comprising:

an alarm step of informing a user of an alarm, wherein said alarm step comprises informing the user of the alarm when said remaining amount of ink is below said predetermined value.

17. The control method as claimed in claim 16, further comprising:

a detecting step of detecting an exchange of said ink tank according to removing said ink tank from said mounting portion or inserting said ink tank into said mounting portion, wherein said control step comprises:

reading said information showing said remaining amount of ink from said information storing portion of said ink tank when said ink tank is exchanged; and informing the user of the alarm when said remaining amount of ink in said ink tank is below said predetermined value according to said information showing said remaining amount of ink.

18. The control method as claimed in claim 10, wherein said printing head ejects the ink by utilizing a thermal energy, and said printing head includes an element generating a thermal energy applied to said ink.

* * * * *

UNITED STATES PATENT AND TRADEMARK OFFICE

CERTIFICATE OF CORRECTION

PATENT NO. : 6,736,477 B2
DATED : May 18, 2004
INVENTOR(S) : Tsuruoka

It is certified that error appears in the above-identified patent and that said Letters Patent is hereby corrected as shown below:

Column 1,
Line 30, “utilized” should read -- utilize --;
Line 51, “form” should read -- from --; and
Line 67, “in” should read -- ink --.

Column 2,
Line 12, “tot he” should read -- to the --;
Line 47, “read those” should read -- reads those pieces of --;
Line 48, “tions” should read -- tion --;
Line 54, “when” should read -- during --; and
Line 67, “in” should read -- ink --.

Column 3,
Line 54, “patterns 10” should read -- patterns 10a --.

Column 5,
Line 2, “with” should be deleted.

Signed and Sealed this

Twenty-third Day of November, 2004

JON W. DUDAS
*Director of the United States Patent and Trademark Office*